US006270211B1

(12) United States Patent
Long et al.

(10) Patent No.: US 6,270,211 B1
(45) Date of Patent: Aug. 7, 2001

(54) BUBBLE ELIMINATION AND FILTER TOWER STRUCTURE

(75) Inventors: Gregory Alan Long; James Harold Powers, both of Lexington; Matthew Joe Russell, Stamping Ground; David Amos Ward, Cynthiana, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/348,764

(22) Filed: Jul. 7, 1999

(51) Int. Cl.[7] ..... B41J 2/19; B41J 2/175
(52) U.S. Cl. ..... 347/92; 347/93
(58) Field of Search ..... 347/93, 92, 85, 347/86

(56) References Cited

U.S. PATENT DOCUMENTS

| | | | | |
|---|---|---|---|---|
| 3,708,118 | | 1/1973 | Keur . | |
| 4,153,902 | | 5/1979 | Kanayama . | |
| 4,301,459 | * | 11/1981 | Isayama et al. | 347/92 |
| 4,628,334 | | 12/1986 | Dagna et al. . | |
| 4,946,204 | * | 8/1990 | Boticki | 285/281 |
| 5,017,941 | * | 5/1991 | Drake | 347/67 |
| 5,119,115 | | 6/1992 | Buat et al. . | |
| 5,425,478 | | 6/1995 | Kotaki et al. . | |
| 5,456,248 | * | 10/1995 | Holian et al. | 128/205.12 |
| 5,515,091 | | 5/1996 | Kimura et al. . | |
| 5,537,136 | | 7/1996 | Brandon et al. . | |
| 5,546,109 | | 8/1996 | Nakano . | |
| 5,606,988 | | 3/1997 | Pawlowski, Jr. . | |
| 5,621,445 | * | 4/1997 | Fong et al. | 347/87 |
| 5,696,546 | | 12/1997 | Narang et al. . | |
| 5,751,322 | | 5/1998 | Miller et al. . | |
| 5,767,881 | | 6/1998 | Geissmann . | |
| 5,777,646 | | 7/1998 | Barinaga et al. . | |
| 5,815,182 | | 9/1998 | Otis et al. . | |
| 5,828,395 | * | 10/1998 | Takata | 347/86 |
| 5,905,518 | | 5/1999 | DeFilippis . | |

FOREIGN PATENT DOCUMENTS

| | | | | |
|---|---|---|---|---|
| 0 645 244 A1 | * | 3/1995 | (EP) | B41J/2/19 |
| 0 676 294 A2 | | 4/1995 | (EP) . | |
| 60-99661-A | * | 6/1985 | (JP) | B41J/3/04 |
| 3-258554 | * | 11/1991 | (JP) | B41J/2/175 |
| 9-109405 | * | 4/1997 | (JP) | B41J/2/175 |

* cited by examiner

*Primary Examiner*—David F. Yockey
(74) *Attorney, Agent, or Firm*—Luedeka, Neely & Graham

(57) ABSTRACT

A printhead apparatus for filtering ink which includes an elongate open-ended trough having a bottom wall and opposing end walls and opposing side walls attached to the bottom wall, an ink exit port attached to the bottom wall between the opposing end walls and side wall, a filter member disposed in the open-ended trough between the end walls and the side walls and an elongate cover assembly attached to the end walls and the side walls covering the trough defining a filter chamber containing filter element, the cover assembly containing an ink inlet valve and a gas outlet valve. The device is disposed between an ink cartridge and an ink jet pen containing one or more printheads and is activated automatically when a new ink cartridge is installed on the pen thereby removing unwanted air and gas bubbles from the filter chamber and providing gas free ink to the pen and one or more printheads.

21 Claims, 6 Drawing Sheets

BUBBLE ELIMINATION AND FILTER TOWER STRUCTURE

FIELD OF THE INVENTION

The invention relates to ink jet printers and in particular to a filter tower structure for attachment to a permanent or semi-permanent ink jet pen.

BACKGROUND OF THE INVENTION

During the lifespan of an ink jet printhead, air or gas bubbles develop in the ink and coalesce into larger bubbles. As the bubbles form and coalesce, they tend to accumulate in filter areas and ink feed channels of the ink jet pen. If the amount of air or gas bubbles increases significantly, performance of the pen may be affected. For disposable pens, air accumulation is not typically a significant problem. However, for longer life permanent or semi-permanent pens, and for high quality, high speed pens, substantial air or gas bubble accumulation may significantly affect printhead performance by causing misfiring or ink flow blockages.

A primary source of air or gas bubbles in the ink feed port of an ink jet pen arises from the removal and connection of ink cartridges with the pen. If a spent ink cartridge is allowed to run dry of ink, air will fill the ink feed port connecting the cartridge to the pen. Even if the ink cartridge is not run dry of ink, a certain amount of air is introduced into the ink feed port each time the ink cartridge is connected and/or disconnected from the pen. Some of the air or gas bubbles which make there way into the ink flow channels of the pen are removed from the printhead through the ejection orifices, however, a portion of the air or gas bubbles finds its way back through the ink feed paths into the ink filter area of the pen.

Priming the pen by ejecting ink from the printhead may remove air or gas bubbles from the printhead itself, however, there may still be a substantial amount of air in the filter area of the pen or cartridge.

An object of the invention is to provide an apparatus and method with improves the operation of an ink jet pen.

Another object of the invention is to provide an apparatus and method for filtering ink for an ink jet printer.

Another object of the invention is to provide a filtration and air removal system which can be easily connected to an ink jet pen.

Still another object of the invention is to provide a method for filtering ink and removing air from the filter device of an ink jet printer.

Another object of the invention is to provide method for connecting an ink filtration system to an ink jet pen which simplifies the manufaturing steps thereof.

SUMMARY OF THE INVENTION

With regard to the foregoing and other object and advantages, the invention provides an apparatus for filtering ink for an ink jet pen which includes an elongate open-ended trough having a bottom wall, opposing end walls and opposing side walls attached to the bottom wall, a filtered ink exit port attached to the bottom wall between the opposing end walls and side walls, a filter element disposed in the open-ended trough between the end walls and the side walls and an elongate cover assembly attached to the end walls and the side walls covering the trough defining a filter chamber containing the ink filter element. The cover assembly of the apparatus contains an ink inlet valve and a gas outlet valve.

In another aspect the invention provides an ink jet printer which includes one or more permanent or semi-permanent printheads on an ink jet pen. One or more removable ink cartridges are attached to the pen, each cartridge containing an ink feed port having an ink flow path in flow communication with the one or more printheads and containing a bellows device for removing air or gas bubbles which accumulate in the ink flow path. At least one filtration and air removal system containing a filter chamber is attached to the pen between the cartridge and the pen for filtering ink flowing to the one or more printheads and for removing air and gas bubbles from filter chamber.

In yet another aspect the invention provides a method for filtering ink and removing air and gas bubbles from one or more ink feed ports of an ink jet pen. The ink jet pen contains one or more printheads disposed on one surface thereof and having an aperture on a second surface thereof for each printhead for flow of ink to the printheads. One or more removable ink cartridges is provided, each cartridge containing ink and having an ink feed port for supplying ink through the ink feed port to at least one printhead. At least one ink filtration and air removal system containing a filter chamber and a filter element in the filter chamber for filtering ink flowing from the one or more cartridges to the one or more printheads is provided. Each filtration and air removal system contains an ink inlet device, an ink inlet port, an air outlet device, an air outlet port and a filtered ink outlet port. The ink outlet ports are connected to the pen so that each outlet port is in flow communication with the aperture corresponding to the printhead. Upon attachment of each ink cartridge to the filtration and air removal system air is removed from the filter chamber.

An advantage of the ink filtration system of the invention is that it is configured to provide a filtered ink compartment having an air accumulation space therein for accumulating, coalescing and channeling unwanted air or gas bubbles in order to effectively remove such unwanted air or gas bubbles from the ink flow paths of the pen and ink cartridge. Removal of unwanted air or gas bubbles from the ink flow paths is substantially automatically activated upon replacement of an ink cartridge without any other operator intervention. Unlike priming devices or methods, the device of the invention is adapted for removal of air or gas bubbles so that only a relatively minute quantity of ink is removed or wasted from the ink cartridge or ink supply port. By "relatively minute" means from about 0 to about 1 milliliter, preferably from about 0.1 to about 0.2 milliliters. Priming devices typically only remove air from the printhead and ink paths in the printhead itself and are not effective for removing air bubbles from the ink filter chamber. The present invention, as described below, provides a substantial improvement in the ability to remove air or gas bubbles from the ink filter chamber and provides a substantially improved ink filtration system.

BRIEF DESCRIPTION OF THE DRAWINGS

Further advantages of the invention will become apparent by reference to the detailed description when considered in conjunction with the figures, which are not to scale, wherein like reference numbers indicate like elements through the sews, and wherein.

DETAILED DESCRIPTION OF THE INVENTION

Figure 1:
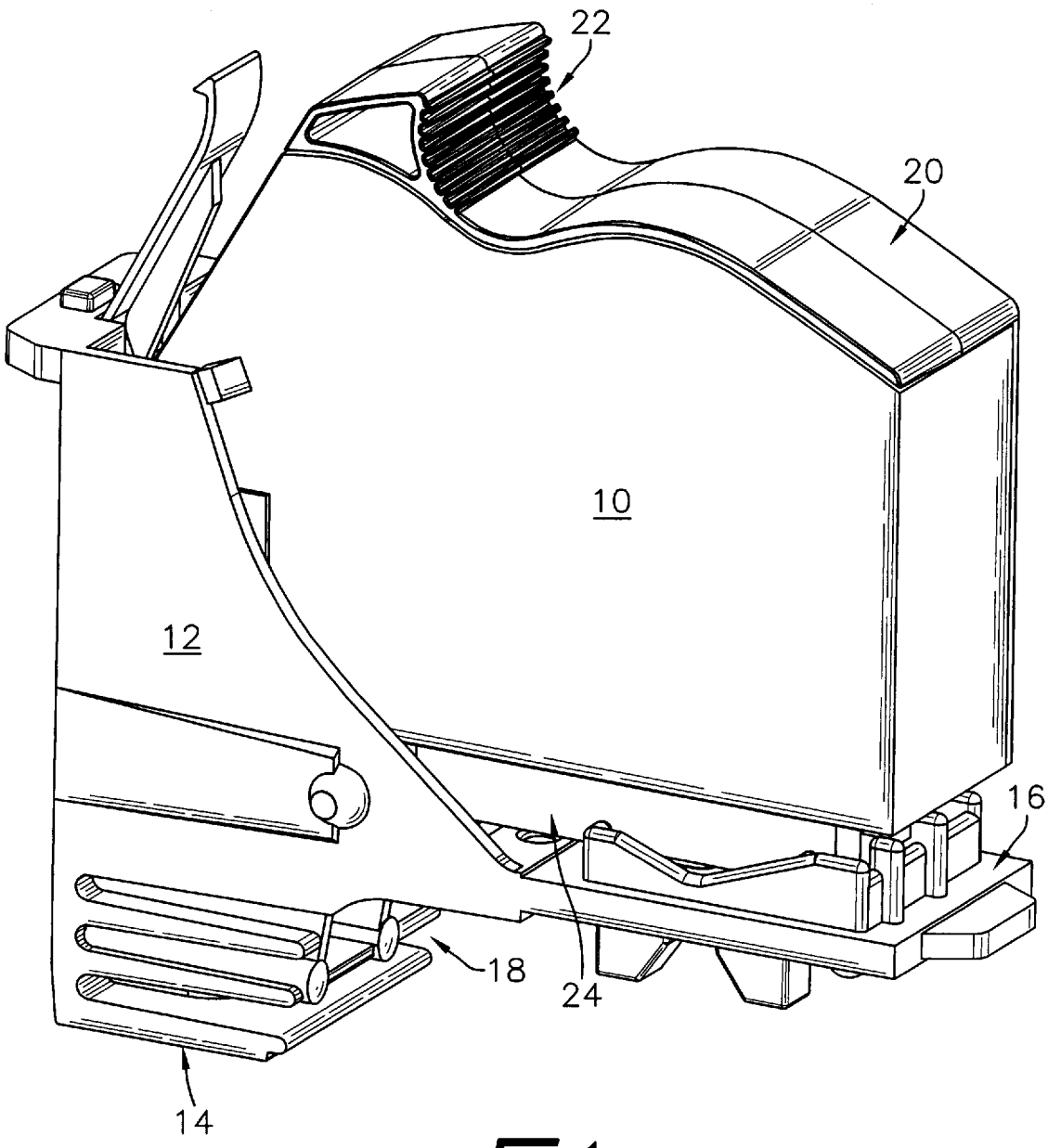
FIG. 1 is a perspective view of a removable ink supply cartridge assembled to an or use in an ink jet printer.

With reference to FIG. 1, there is shown, in perspective view, a replaceable ink cartridge 10 connected to a permanent or semi-permanent ink jet pen 12. The ink cartridge 10 may contain a single color ink, such as black, cyan, magenta or yellow or may contain multiple colors of ink. The pen 12 may be configured to contain a single cartridge 10 or may be expanded to hold multiple cartridges 10. In the case of a single color ink cartridge 10, the pen 12 typically contains a single printhead 14 on a side of the pen 12 opposite the cartridge connection side 16 thereof. In the case of multiple cartridges 10 or multicolor cartridges 10, the pen 12 may contain multiple printheads 14, typically three or four printheads 14.

In high speed, high quality printing operations, it is preferred that the pen 12 be adapted to remove heat from the printhead 14. This may be accomplished by constructing the pen 12 out of a heat conducting metal such as aluminum or zinc and/or by providing heat conducting fins 18 on the pen 12 to conduct heat away from the printhead 14 by conduction and/or convention.

With regard to the ink cartridge 10, the cartridge 10 hag an upper portion 20 containing a handle 22 and a lower portion 24. A vacuum chamber and bellows device (which will be described in more detail below) is preferably disposed in the lower portion 24 of the cartridge 10.

Figure 2:
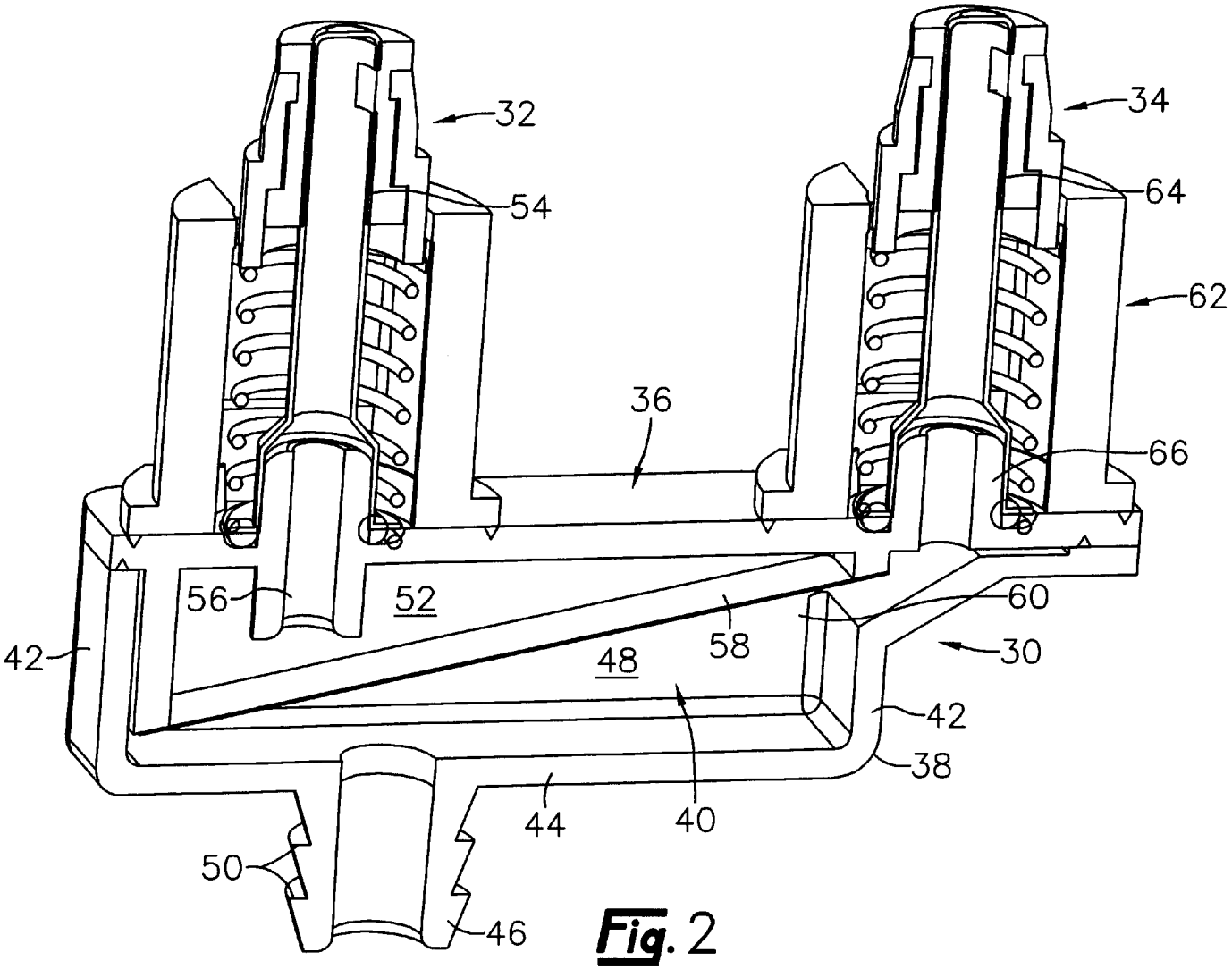
FIG. 2 is a cross-sectional view of a filtration and air removal device according to the invention.

An important feature of the invention is an ink filtration and air removal system 30 shown in cross-sectional view in FIG. 2. The ink filtration and air removal system 30 includes an ink feed needle valve assembly 32 and a gas removal needle valve assembly 34 attached to the upper portion 36 of an elongate, sustantially rectangular filter cavity 38. The filter cavity 38 is defined by the upper portion 36, side walls 40, end walls 42 and bottom portion 44. An ink outlet port 46 is attached to the bottom portion 44 and is in flow communication with filtered ink in a filtered ink and gas removal chamber 48 of the filter cavity 38, The outlet port 46 preferably contains barbs or palls 50 which are used to sealingly connect the filtration and air removal system 30 to an ink jet pen.

Upon connection of a removable ink cartridge with the filtration and air removal system 30, ink and air or gas flow into an upper chamber 52 of the filter cavity 38 through an elongate ink needle 54 and ink inlet port 56 attached to the top portion 36. Debris and impurities are removed from the ink in the upper chamber 52 by means of filter element 58 so that purified ink accumulates in the filtered ink and gas chamber 48. Because the filter element 58 is not horizontally disposed in the filter cavity 38, air or gas bubbles are caused to accumulate in a gas accumulation area 60 of the cavity 38 adjacent a gas removal needle valve assembly 62. The gas removal needle valve assembly 62 contains an elongate gas removal needle 64 which is in flow communication with the gas accumulation area 60 by means of a gas removal port 66 which is formed in the upper portion 36 of the filter cavity 38.

Figure 3:
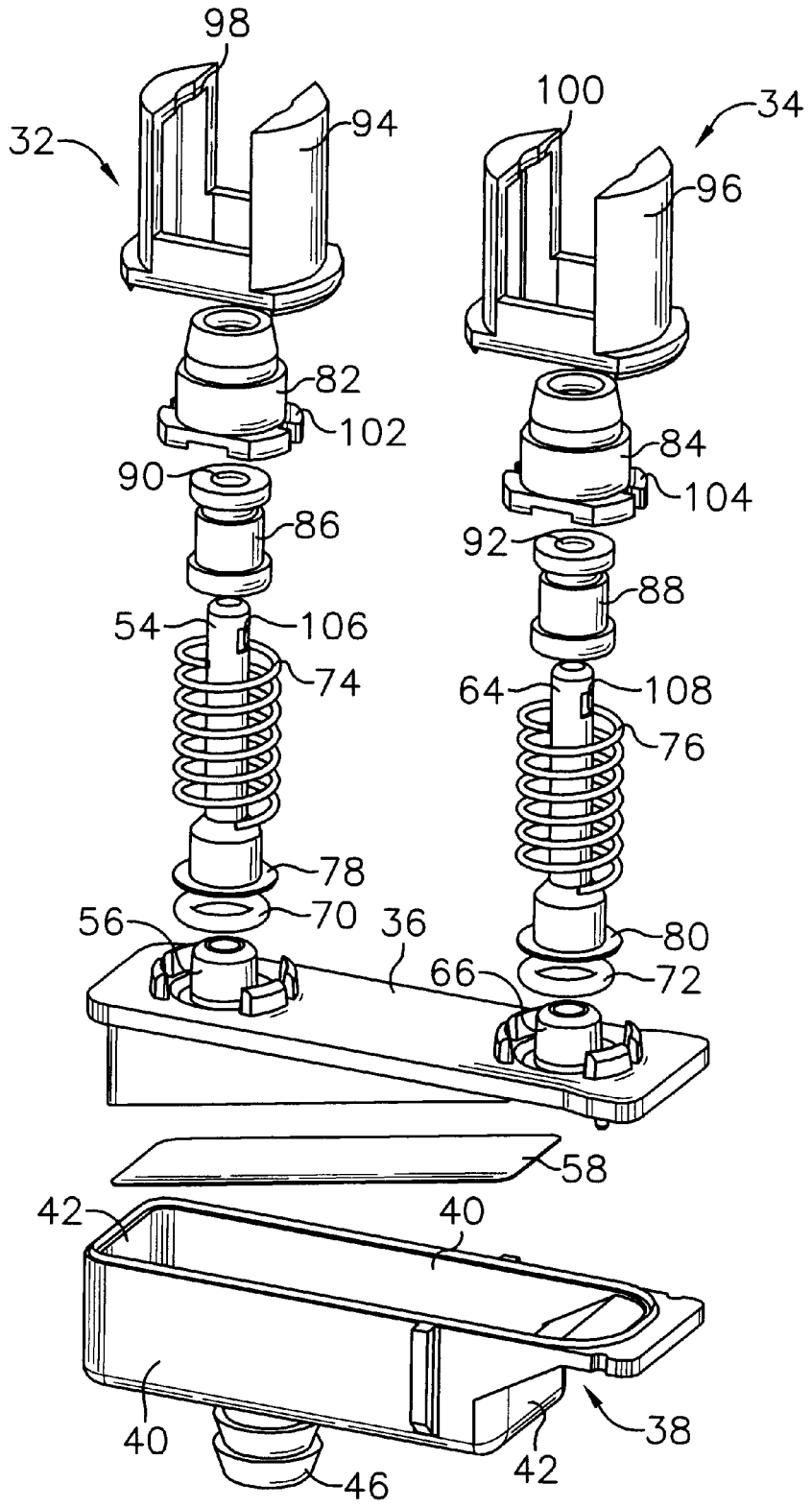
FIG. 3 is an exploded view in perspective of a filtration and air removal device according to the invention.

Details of a preferred filtration and air removal system 30 shown in FIG. 2 may be seen in an exploded view of the system 30 with further reference to FIG. 3. As can be seen, needle valve assemblies 32 and 34 are preferably substantially the same. The assemblies 32 and 34 include the elongate needles 54 and 64 which are sealingly attached to the ports 56 and 66 by means of resilient sealing devices such as o-rings 70 and 72. Valve springs 74 and 76 are disposed around elongate needles 54 and 64 between needle flanges 78 and 80 and spring urging devices 82 and 84. The spring urging devices 82 and 84 carry cylindrical valves 86 and 88 having annular openings 90 and 92 therein for receiving the elongate needles 54 and 64 therethrough. Valve guides 94 and 96 are attached to the top portion 36 and contain valve travel stop ledges 98 and 100 which engage flanges 102 and 104 of the spring urging devices 82 and 84.

In their closed positions, valves 86 and 88 are urged away from top portion 36 by springs 74 and 76 so that the valves 86 and 88 cover inlet holes 106 and 108 in elongate needles 54 and 64. Upon attachment of an ink cartridge 10, spring urging devices 82 and 84 are urged toward upper portion 36 thereby depressing springs 74 and 76 and lowering valves 86 and 88 to expose ink inlet hole 106 and gas outlet hole 108. Upon removal of the ink cartridge 10, the springs 74 and 76 again urge valves 86 and 88 away from the top portion 36 so that valves 86 and 88 again cover and seal ink inlet hole 106 and gas outlet hole 108.

Figure 4:
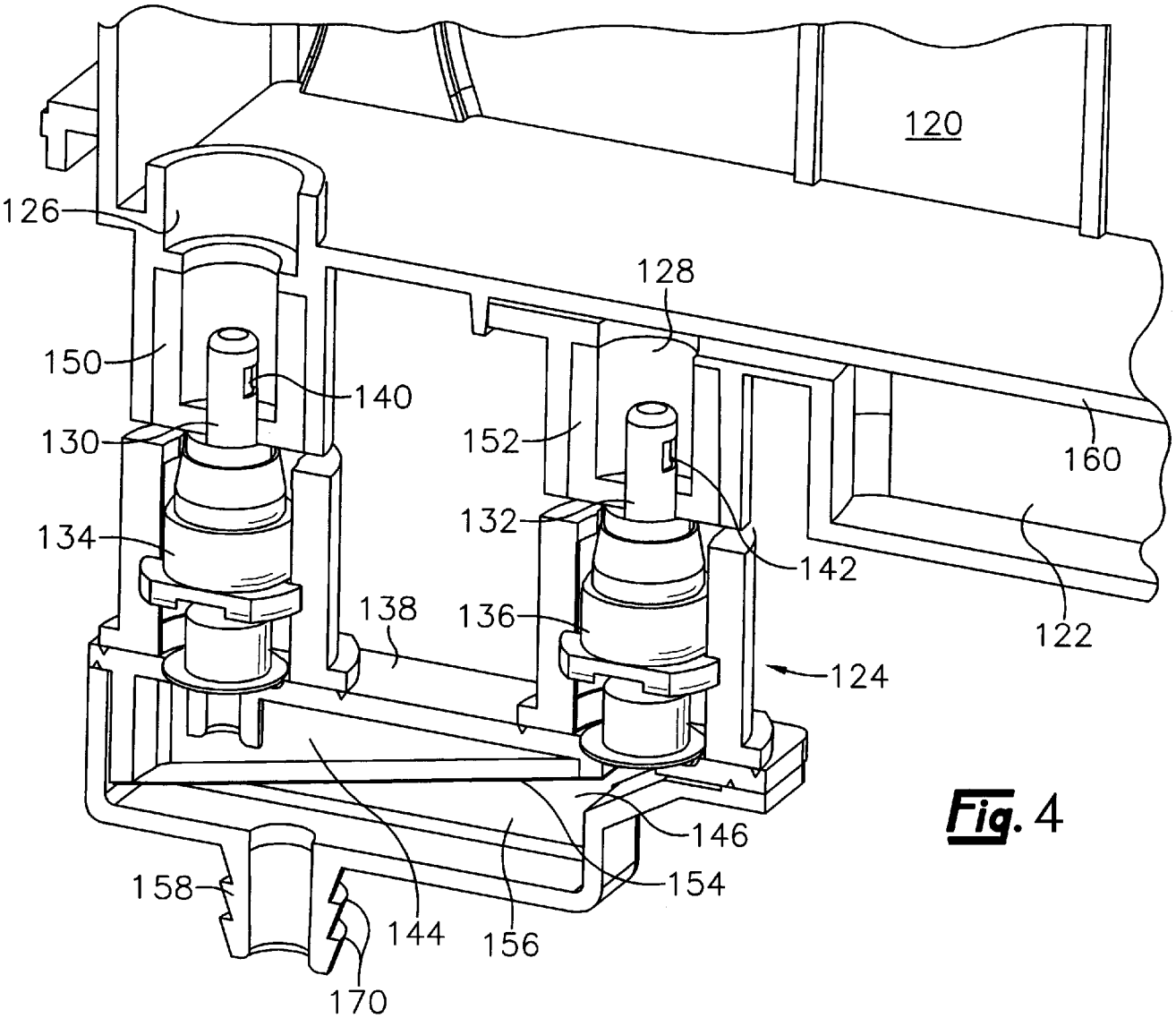
FIG. 4 is a cross-sectional view of a filtration and air removal device according to the invention assembled to a removable ink supply cartridge containing a gas removal bellows.

With reference now to FIG. 4, a partial cross-section view of an ink cartridge 120, bellows chamber 122 and filtration and air removal system 124 is shown with the filtration and air removal system 124 being engagedly connected to the ink cartridge 120. When the ink cartridge 120 and filtration and air removal system 124 are connected, ink supply port 126 and air or gas bubble removal port 128 engage needles 130 and 132, respectively which in turn urge spring urging devices 134 and 136 containing valves 86 and 88 (FIG. 3) toward upper portion 138 of the filtration and air removal device 124. Upon urging valves 86 and 88 downward, ink inlet hole 140 and gas outlet hole 142 of needles 130 and 132 respectively are uncovered so that the filter cavity 144 is connected in flow communication with the ink outlet port 126 of the ink cartridge 120 by means of ink needle 130. Likewise, a gas accumulation area 146 is connected in flow communication with the air or gas bubble removal port 128 for flow of air and/or gas through gas outlet needle 132 into a bellows system chamber 122.

Figure 5:
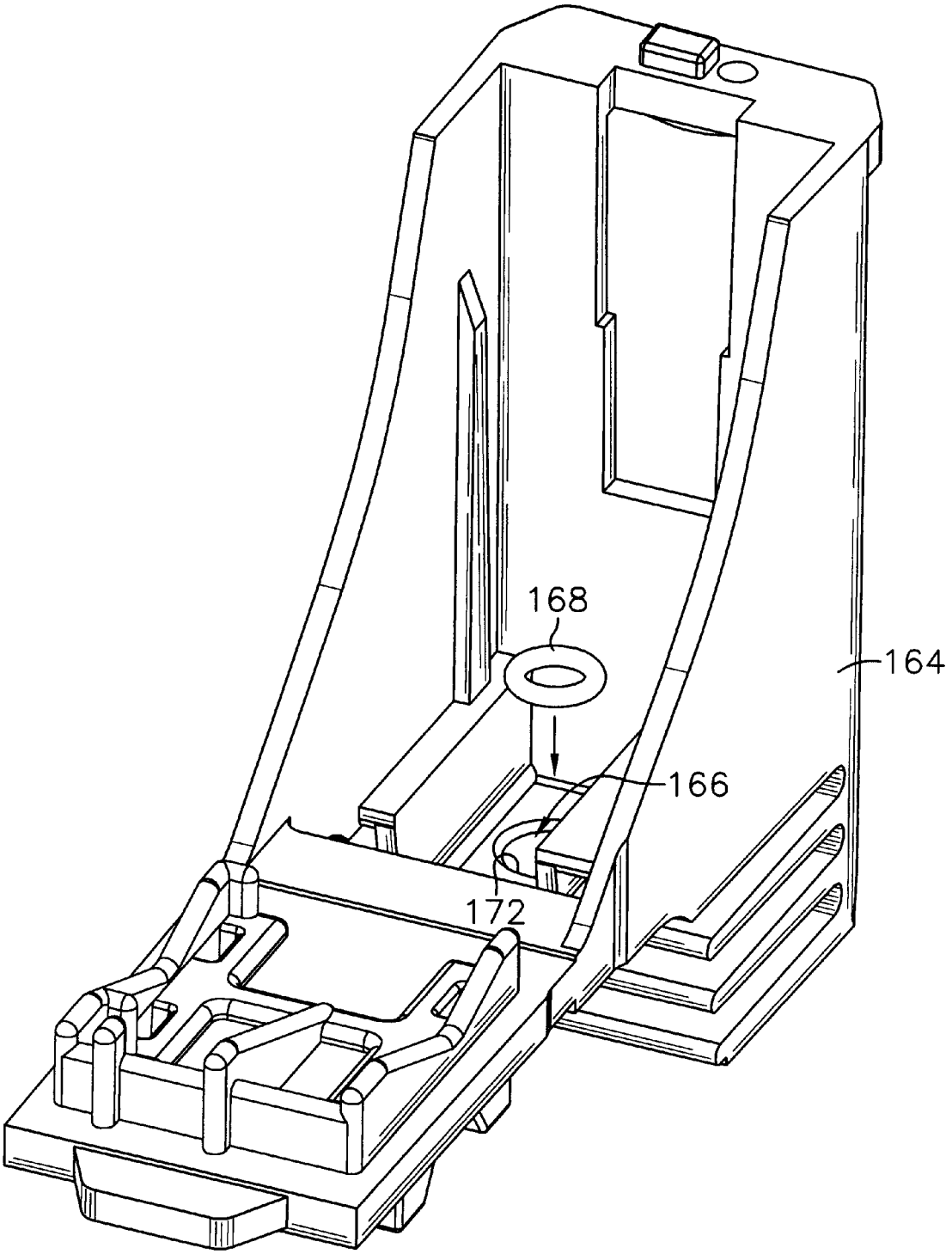
FIG. 5 is a perspective view of an ink jet pen and o-ring for attachment to a filtration and air removal device thereto according to the invention.

In order to seal the ink supply port 126 of the ink cartridge 120 against flow of ink out of the cartridge adjacent ink needle 130, ink supply port 126 preferably contains an elastomeric septum 150 which sealingly engages needle 130. Likewise, air or gas bubble removal port 128 preferably contains a septum 152 for sealingly engaging needle 132. Upon flow of ink into filter cavity 144, the ink is filtered to remove particles and debris by a filter 154 and the purified ink flows a filtered ink chamber 156 for flow out of ink supply port 158 into the pen 164 (FIG. 5).

Connection of the filtration and air removal device 124 to an ink jet pen 164 (FIG. 5) may be effected by inserting the ink supply port 158 into an opening or aperture 166 in the pen 164. In order to sealingly connect the ink supply port 158 with aperture 166, an elastomeric bushing, collar or o-ring 168 may be inserted into the aperture 166 or disposed around the ink supply port 158 in a groove. In the case of an elastomeric bushing or collar, the ink supply port 158 may contain palls or barbs 170 (FIG. 4) for sealingly engaging the inside surface area of the collar or bushing and for forcing the outside surface area of a collar or bushing in close adjacency with the inside surface area 172 of aperture 166. The o-ring 168 is preferably made of an elastomeric material, including, but not limited to, natural rubber, synthetic rubber, polyurethane foam, silicone and the like, provided the material selected for the collar is resistant to the ink and effectively forms a seal to prevent ink or air leakage therethrough. Other means may be used to seal the connection between the ink supply port 158 and the aperture 166 in carrier 164 including, but not limited to, the use of adhesive with or without the use of a collar, bushing or o-ring 168, and/or thermoplastic welding of the filtration and air removal device 124 to the pen 164.

Figure 6:
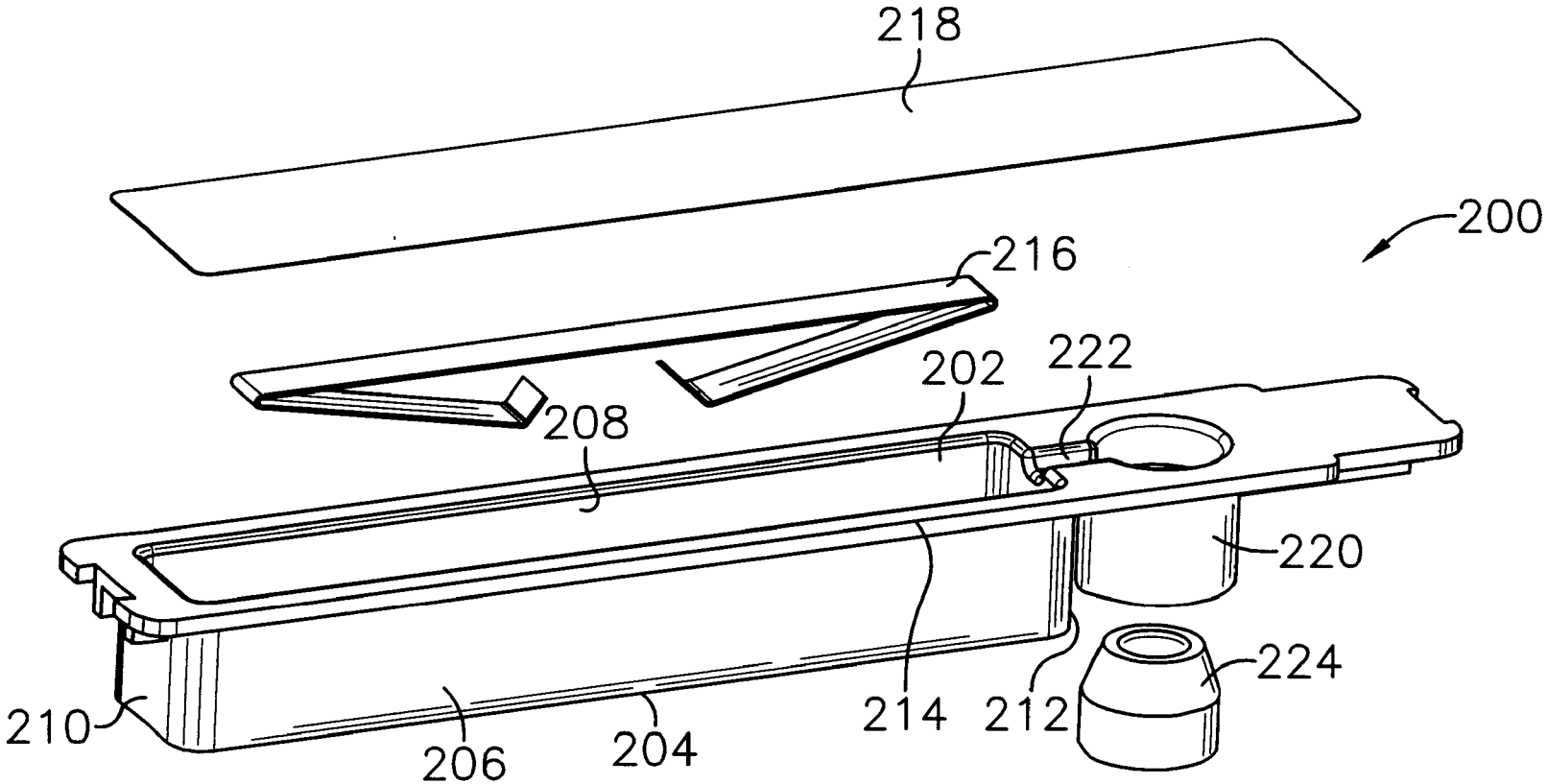
FIG. 6 is an exploded view in perspective of a bellows gas removal device used in conjunction with a removable ink cartridge and a filtration and air removal device according to the invention.

An exploded view of a preferred bellows system 200 is shown in FIG. 6. The bellows system 200 includes a vacuum chamber 202 which is defined by a bottom portion 204, side portions 206 and 208, end portions 210 and 212 and a top edge portion 214. An urging device 216 is disposed in the cavity 202 and a seal member 218 is attached along the top edge portion 214 to seal the vacuum chamber 202.

The urging member 216 is preferably a resilient leaf spring device which is disposed in the chamber 202, preferably in an initially compressed state, between the bottom portion 204 and the seal member 218. The purpose of the urging member 216 is to urge the seal member 218 in a direction away from the bottom portion 204 of the chamber 202 upon connection of the bellows system 200 with an ink filtration and air removal system 30 as described above with reference to FIGS. 2 and 3. A wide variety of urging members 216 may be used, including but not limited to coil springs and resilient elastomeric open cell foam materials. Useful elastomeric foam materials include, but are not limited to, unfelted ether or ester type polyurethane foams and open-cell polyolefinic foams. Such foam materials are described, for example, in U.S. Pat. No. 5,400,067 to Day incorporated herein by reference as if fully set forth.

The seal member 218 is preferably made of a flexible thin film material such as a low density polyethylene film, polypropylene film, cellophane, vinyl and the like which is attached to the top edge portion 214 of the chamber 202. An air-tight seal is preferably formed between the seal member 218 and the top edge portion 214 of the chamber 202 by melting the seal member 218 around the perimeter of the chamber 202 and/or by use of adhesives. Other means such as clamp rings, etc. may be used to sealingly attach the seal member 218 to enclose the vacuum chamber 202 of the bellows device 200. It is preferred that the seal member 218 by resilient so that it can be initially urged toward the bottom portion 204 of the chamber 202 thereby depressing the urging member 216 without tearing or excessive stretching of the seal member 218.

The bellows system 200 also contains a vacuum release port 220 which is in flow communication with the chamber 202 by means of a gas flow channel 222. The gas flow channel 222 preferably has a width of about 0.5 to about 3 millimeters and a height of about 0.5 to about 3 millimeters thereby providing an orifice for flow of gas into the vacuum chamber 202. In order to provide a bellows system 200 having an initial subatmospheric pressure in the chamber 202 thereof, air is urged from the chamber 202 by depressing the seal member 218 and urging member 216 toward the bottom portion 204 of the chamber 202 and sealing the vacuum release port 220 with a port sealing device 224. A preferred port sealing device 224 is an elastomeric septum which may be punctured by a needle-like device or needle 132 (FIG. 4) and which effectively seals around the circumference of the needle-like device after puncture thereof to substantially eliminate any air or gas leakage therebetween.

Air or gas may thus be introduced into the bellows system 200 by means of puncturing the port sealing device 224 thereby causing urging device 216 and seal member 218 away from the bottom portion 204 of the chamber 202 as the air or gas flows from vacuum release port 220, through channel 222 into chamber 202. Urging device 216 therefor causes a suctioning effect as the seal member 218 is urged upward and away from the bottom portion 204.

As shown, the bellows system 200 preferably includes an elongate substantially rectangular vacuum chamber 202. The chamber 202 preferably has a volume of about 1 to about 30 nL, preferably about 3 nL. The invention is not intended to be limited to the shape of the bellows device 200 as shown in FIG. 5 as other shapes may be used for the bellows device 200 such a cylindrical, spherical, oval and the like, provided the vacuum chamber 202 has sufficient volume for removal of air or gas bubbles from the ink feed port areas of an ink cartridge and pen.

After initially depressing the seal member 218 towards the bottom portion 204, and sealing the vacuum release port 220 with the septum 224, the entire bellows system 200 is attached to an ink cartridge 120 (FIG. 4) so that the side of the seal member 218 opposite the vacuum chamber 202 and urging device 216 is adjacent the lower portion 160 of the cartridge 120 (FIG. 4). The bellows system 200 may be removably connected to the lower portion 160 as by means of clips or may be permanently attached to the cartridge 120 by thermoplastic welding techniques or by use of adhesives.

It is preferred that ink flow to the pen 164 (FIG. 5) from the cartridge 120 be established before activating the bellows system 200 to remove air from the gas accumulation area 146 (FIG. 4). This may be accomplished in a variety of ways. For example, needle 130 may be slightly longer than needle 132 so that needle 130 is in ink flow communication with the cartridge 120 before needle 132 is in gas flow communication with bellows system 200. Alternatively, the cartridge 120 may be tilted to engage needle 130 before engaging needle 132 while the cartridge 120 is being attached to the filtration and air removal system.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. An apparatus for filtering ink for an ink jet pen comprising an elongate open-ended trough having a bottom wall, opposing end walls and opposing side walls attached to the bottom wall, a tubular filtered ink exit port attached to the bottom wall between the opposing end walls and side walls, said ink exit port being separate from the ink jet pen and being insertable into an aperture in the ink jet pen containing one or more printheads, a filter element diagonally disposed in the open-ended trough between the end walls and the side walls, and an elongate cover assembly attached to the end walls and the side walls covering the trough defining a filter chamber containing the ink filter element, wherein the cover assembly contains art ink inlet valve and a gas outlet valve, and wherein the filter element provides a substantially smooth transition from within the filter chamber to adjacent the gas outlet valve.

2. The apparatus of claim 1 wherein the tubular filtered ink exit port further comprises barbs or palls.

3. The apparatus of claim 1 wherein the tubular filtered ink exit port contains a groove with an elastomeric o-ring disposed therein.

4. The apparatus of claim 3 wherein the filter chamber is sealingly connected to an ink jet pen by means of an o-ring.

5. The apparatus of claim 1 wherein the filter chamber is sealingly connected to an ink jet pen by means of an adhesive.

6. An ink jet printer comprising an ink jet pen containing one or more permanent or semi-permanent printheads, each of the printheads having an ink flow path in flow communication therewith, the pen including one or more removable ink cartridges attached thereto, each of the one or more cartridges having an ink feed port corresponding to one ink flow path for ink flow communication between the one or more cartridges and the one or more printheads, the pen including a separately attachable filtration and air removal system for each ink feed port, each filtration and air removal system being attached to the pen and the corresponding ink feed port, each filtration and air removal system containing a filter chamber for providing filtered ink to the pen and for removing air and gas bubbles from the filtered ink, each filtration and air removal system having a tubular ink outlet port for connection to a corresponding aperture in the pen so that the filtration and air removal system is disposed between the pen and the corresponding one of the one or more ink cartridges, each of the one or more cartridges having a bellows device attached thereto and each filtration and air removal system having an air outlet port in flow communication with the corresponding bellows device for removing air and gas bubbles from the filter chamber, wherein each filter chamber includes a diagonally disposed filter element providing a substantially smooth transition from within the corresponding filter chamber to adjacent the corresponding air outlet port.

7. The printer of claim 6 wherein each tubular ink outlet port contains barbs or palls on an outside surface thereof.

8. The printer of claim 7 wherein a resilient sealing member is disposed in each aperture for sealingly engaging said barbs or palls.

9. The printer of claim 6 wherein each tubular ink outlet port is sealingly engaged in the corresponding aperture by means of an adhesive.

10. The printer of claim 6 wherein each aperture contains an elastomeric o-ring disposed therein for sealingly engaging the corresponding tubular ink outlet port.

11. The printer of claim 6 wherein each of the one or more ink cartridges further comprises one or more inks.

12. The printer of claim 6 wherein each ink filtration and air removal system further comprises an elastomeric o-ring seal on the corresponding tubular ink outlet port for sealingly engaging the corresponding aperture of the pen.

13. A method for filtering ink and removing air and gas bubbles from ink fed to an ink jet pen which comprises:

providing an ink jet pen having a first surface, a second surface, one or more printheads disposed on the first surface thereof and an aperture in the second surface thereof corresponding to each of the one or more printheads for flow of ink to the printheads;

providing a separate ink filtration and air removal system for each of the one or more printheads, each ink filtration and air removal system containing a filter chamber and a filter element diagonally disposed in the filter chamber for filtering ink flowing to each of the one or more printheads, each ink filtration and air removal system containing an ink inlet device, an ink inlet port, an air outlet device, an air outlet port and a tubular filtered ink outlet port, each filter element providing a substantially smooth transition from within the corresponding filter chamber to adjacent the corresponding air outlet port;

connecting each filtered ink outlet port of the ink filtration and air removal system to the corresponding aperture in the second surface of the pen so that each outlet port is flow communication with the corresponding aperture;

providing one or more removable ink cartridges containing ink, each of the one or more cartridges having a bellows device attached thereto and at least one ink feed port for supplying ink to the ink jet pen, each bellows device having an air inlet port; and removably attaching each ink feed port to the ink inlet port and each air inlet port to the air outlet port of a corresponding one of the filtration and air removal system so that air is removed from each filter chamber upon attachment of the corresponding one of the one or more cartridges to the ink jet pen.

14. The method of claim 13 wherein each of the cartridges is connected to the corresponding ink filtration and air removal system in a manner which induces ink flow to the filter element before removing air from the filter chamber.

15. The method of claim 13 wherein each tubular filtered ink outlet port is slidingly engaged with one aperture on the pen.

16. The method of claim 15 further comprising inserting a resilient sealing member in each aperture of the pen for sealingly engaging the corresponding tubular filtered ink outlet port.

17. The method of claim 16 wherein each tubular filtered ink outlet port contains barbs or palls for compressing the resilient sealing member against an inside surface of the corresponding aperture.

18. The method of claim 15 further comprising attaching each tubular filtered ink outlet port in the corresponding aperture by means of an adhesive.

19. The method of claim 15 wherein each aperture contains an elastomeric o-ring disposed therein for sealingly engaging the corresponding tubular filtered ink outlet port.

20. The method of claim 13 further comprising connecting each ink filtration and air removal system to the second surface of the pen by means of an adhesive.

21. The method of claim 13 wherein each ink filtration and air removal system contains an elastomeric o-ring seal on the corresponding tubular filtered ink outlet port, the method further comprising sealingly connecting each ink filtration and air removal system to the pen by compressing the o-ring seal in the corresponding aperture.

* * * * *